US007484499B2

(12) United States Patent
Beardmore

(10) Patent No.: US 7,484,499 B2
(45) Date of Patent: Feb. 3, 2009

(54) COMBUSTION SEAL

(75) Inventor: John M. Beardmore, Howell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/695,895

(22) Filed: Apr. 3, 2007

(65) Prior Publication Data

US 2008/0245340 A1 Oct. 9, 2008

(51) Int. Cl.
*F02M 61/14* (2006.01)
*F02M 61/18* (2006.01)

(52) U.S. Cl. ..... 123/470; 239/533.11

(58) Field of Classification Search ..... 123/470, 123/467, 468, 469; 239/533.11; 277/591, 277/626, 644

See application file for complete search history.

(56) References Cited

U.S. PATENT DOCUMENTS

| | | | | |
|---|---|---|---|---|
| 6,186,123 | B1 * | 2/2001 | Maier et al. | 123/470 |
| 6,196,195 | B1 * | 3/2001 | Trutschel et al. | 123/470 |
| 6,817,341 | B2 * | 11/2004 | Scheffel | 123/470 |
| 2007/0113828 | A1 * | 5/2007 | Fonville et al. | 123/470 |
| 2007/0175451 | A1 * | 8/2007 | Beardmore | 123/470 |

* cited by examiner

*Primary Examiner*—Mahmoud Gimie

(57) ABSTRACT

A combustion seal for a fuel injector assembly mountable within a cylinder head of an internal combustion engine is provided. The combustion seal is energized by combustion gases within a combustion chamber to effect sealing of an injector tip portion of the fuel injector assembly with respect to the cylinder head, thereby preventing the leakage or escape of combustion gases from the combustion chamber. A cylinder head assembly including the combustion seal is also disclosed.

20 Claims, 4 Drawing Sheets

COMBUSTION SEAL

TECHNICAL FIELD

The present invention relates to a combustion seal for a direct injection internal combustion engine.

BACKGROUND OF THE INVENTION

Recent advances in fuel delivery and combustion research have allowed direct injection, or DI, fuel delivery systems to increase in popularity. The DI fuel delivery system provides a fuel injector within the cylinder head of the internal combustion engine. The fuel injector operates to inject a predetermined amount of fuel directly into the combustion chamber at a predetermined time. The DI fuel delivery system enables higher power levels, improved fuel economy, and lower emissions. These beneficial aspects of the DI fuel delivery system are a result of the precise metering of the fuel injected into the combustion chamber as well as improved intake airflow into the combustion chamber.

SUMMARY OF THE INVENTION

A fuel injector assembly mountable within an injector bore defined by a cylinder head of an internal combustion engine is provided. The fuel injector includes a fuel injector body having an injector tip portion configured to be at least partially received within the injector bore. An annular groove is defined by the injector tip and is configured to receive a generally annular combustion seal subject to combustion gas pressures. The annular groove includes a generally tapering portion. The generally annular combustion seal is biased against the generally tapering portion of the annular groove when the generally annular combustion seal is subject to combustion gas pressures. The generally annular combustion seal is biased radially outward to sealingly engage the injector bore when the generally annular combustion seal is biased against the generally tapering portion of the annular groove. A cylinder head assembly incorporating the fuel injector assembly is also disclosed.

In another embodiment, a cylinder head assembly for an internal combustion engine is provided. The cylinder head assembly includes a cylinder head at least partially defining a combustion chamber. An injector piloting sleeve is mounted within the cylinder head and defines an injector bore. A fuel injector assembly having an injector body and an injector tip portion is also provided. The injector tip portion is at least partially disposed within the injector bore and is in communication with the combustion chamber. An annular groove, having a generally tapering portion, is defined by the injector piloting sleeve and is configured to receive a generally annular combustion seal subject to combustion gas pressures within the combustion chamber. The generally annular combustion seal is biased against the generally tapering portion of the annular groove when the generally annular combustion seal is subject to combustion gas pressures. Furthermore, the generally annular combustion seal is biased radially inward to sealingly engage the injector tip portion when the generally annular combustion seal is biased against the generally tapering portion of the annular groove.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
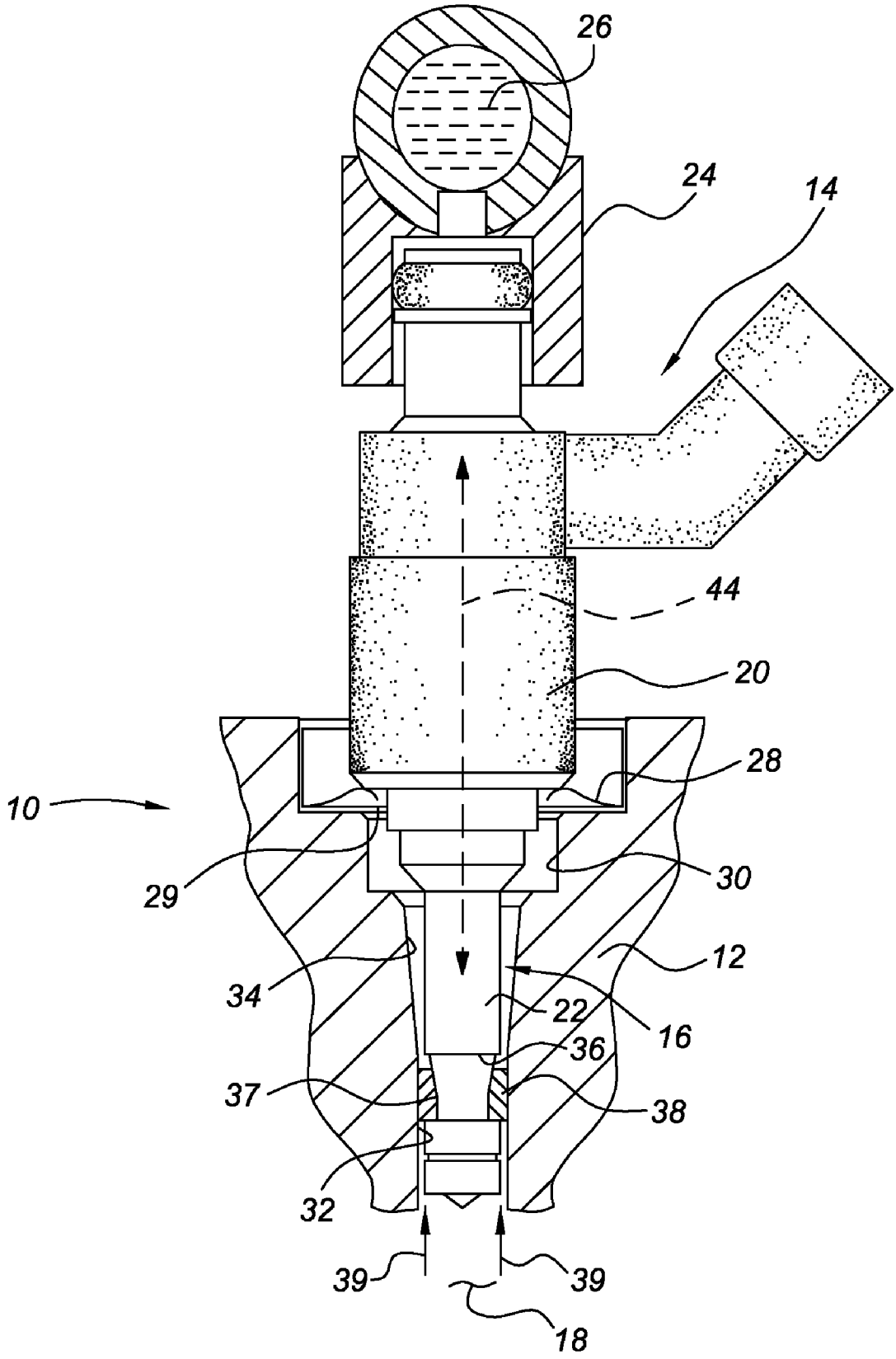
FIG. 1 is a sectional view of a portion of a cylinder head assembly with a fuel injector assembly mounted thereto illustrating a combustion seal energized by combustion gases.

Referring to the drawings wherein like reference numbers correspond to like or similar components throughout the several figures, there is shown in FIG. 1 a portion of a cylinder head assembly 10 for a direct injection internal combustion engine, not shown. The cylinder head assembly 10 includes a cylinder head 12 formed from a cast metal such as aluminum, iron, magnesium, etc. having a fuel injector assembly 14 mounted thereto. The cylinder head 12 defines an injector bore 16 and partially defines a combustion chamber 18. The injector bore 16 is in communication with the combustion chamber 18. The fuel injector assembly 14 includes an injector body 20 having an injector tip portion 22 extending therefrom. The injector bore 16 is configured to receive the injector tip portion 22 such that the injector tip portion 22 is in communication with the combustion chamber 18.

A fuel rail 24 is mounted with respect to the fuel injector assembly 14 and is operable to provide a source of pressurized fuel 26 to the fuel injector assembly 14. The fuel injector assembly 14 is operable to communicate metered and timed amounts of pressurized fuel 26 from the fuel rail 24 directly into the combustion chamber 18 for subsequent combustion therein. As such, the fuel injector assembly 14 may be characterized as a direct injection fuel injector. An isolator member 28 is disposed between the cylinder head 12 and the fuel injector assembly 14 and is operable to provide a measure of compliance such that hard contact or grounding between the fuel injector assembly 14 and the cylinder head 12 is prevented. In so doing, the transmission of noise producing vibrations between the fuel injector assembly 14 and the cylinder head 12 is reduced. A secondary seal 29 is operable to seal the injector body 20 with respect to the cylinder head 12.

The injector bore includes first and second generally cylindrical portions 30 and 32, respectively, having a generally tapering bore portion 34 therebetween. The generally tapering bore portion 34 is operable to guide or pilot the injector tip portion 22 into the second generally cylindrical portion 32 during insertion of the fuel injector assembly 14. Since the fuel injector assembly 14 is in direct communication with the combustion chamber 18, the fuel injector assembly 14 is subject to high pressure loads and temperatures of the combustion process. Therefore, the fuel injector assembly 14 must be sealed with respect to the cylinder head 12. The injector tip portion 22 defines an annular groove 36 configured to receive a portion of a combustion seal 38. The annular groove 36 includes a generally tapering portion 37 operable to radially expand the combustion seal 38 as the combustion seal 38 is biased thereon by combustion gases, indicated by arrows 39, within the combustion chamber 18. The combustion seal 38 is generally annular and sleeve-like in shape and is operable to sealingly engage the second generally cylindrical portion 32 of the injector bore 16 thereby preventing combustion gases 39 from traversing the injector bore 16 during operation of the internal combustion engine. The combustion seal 38 is preferably formed from glass or carbon filled polytetrafluoroethylene; however, other materials may be employed possessing the requisite temperature and chemical resistance while remaining within the scope of that which is claimed.

Figure 2:
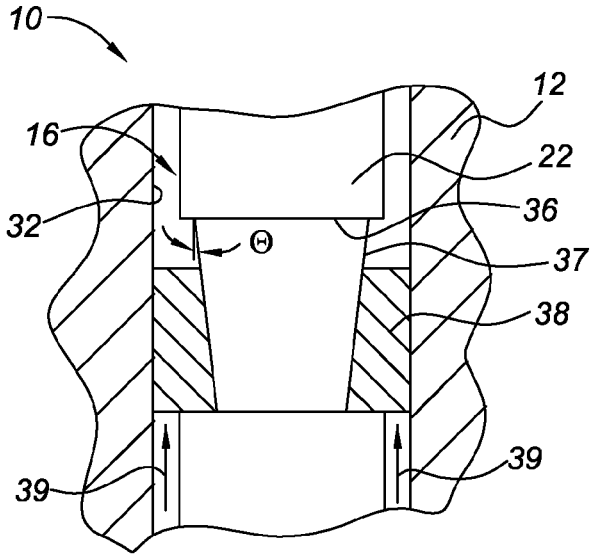
FIG. 2 is a magnified view of a portion of the cylinder head assembly of FIG. 1 illustrating aspects of the combustion seal.

Referring to FIG. 2 and with continued reference to FIG. 1, there is shown a portion of the cylinder head assembly 10 enlarged to illustrate further aspects of the present embodiment. In operation, the combustion seal 38 is subject to pressure forces exerted thereon by the combustion gases 39. As a result, the combustion seal 38 is biased upward, as viewed in FIG. 2, against the generally tapering portion 37 of the annular groove 36. As the combustion seal 38 is biased against the generally tapering portion 37, the generally tapering portion 37 expands the combustion seal 38 radially outward to sealingly engage the second generally cylindrical portion 32 of the injector bore 16. As such, the combustion seal 38 may be characterized as an "energized" combustion seal. That is, the combustion seal 38 is energized by the pressure forces of the combustion gases 39 to effect sealing of the injector tip portion 22 with respect to the injector bore 16. Therefore, the sealing effectiveness of the combustion seal 38 is proportional to the pressure forces acting on the combustion seal by the combustion gases 39. The generally tapering portion 37 of the annular groove 36 has a taper angle Θ, shown in FIG. 2. In the preferred embodiment the taper angle Θ is approximately 12 to approximately 20 degrees. This range of taper angles will enable ease of insertion of the injector tip portion 22 within the injector bore 16 during assembly, while maintaining adequate sealing effectiveness of the combustion seal over a range of friction coefficients for the injector bore 16, injector tip portion 22, and the combustion seal 38.

In operation, the fuel injector assembly 14 will exhibit small axial movements, as illustrated by arrow 44, as a result of variations in pressure within the combustion chamber 18 and the pressurized fuel 26 within the fuel rail. The isolation member 28 may tend to increase the magnitude of this movement. Since the combustion seal 38 is energized by pressure forces exerted by the combustion gases 39, the combustion seal 38 is operable to maintain a seal between the injector tip portion 22 and the second generally cylindrical portion 32 of the injector bore 16 during axial movement of the fuel injector assembly 14.

Figure 3A:
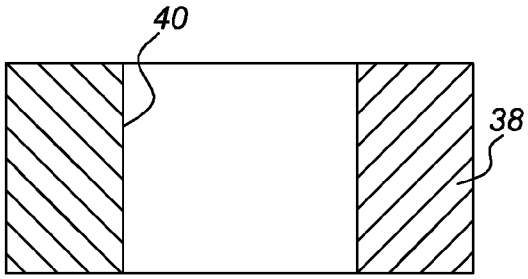
FIG. 3*a* is a cross sectional view of the combustion seal of FIGS. 1 and 2.
Figure 3B:
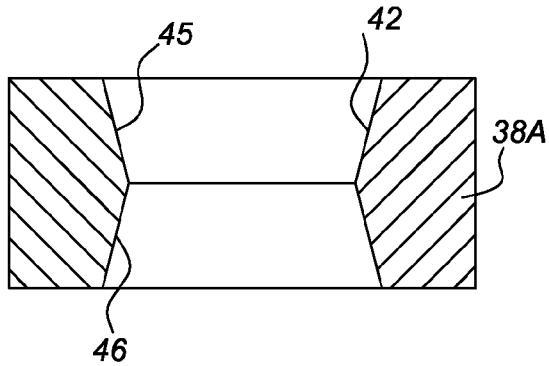
FIG. 3*b* is a cross sectional view of an alternate embodiment of the energized combustion seal of FIG. 3*a;*

Referring to FIG. 3*a* and with continued reference to FIGS. 1 and 2, there is shown the combustion seal 38 in an undeformed state, i.e. prior to installation within the generally annular groove 36. As shown, the combustion seal 38 has a bore 40 that extends the length of the combustion seal 38. The bore 40 is shown in FIG. 3*a* as generally cylindrical; however, the bore 40 may have a generally tapering shape to complement the taper angle Θ of the generally tapering portion 37. Referring to FIG. 3*b* and with continued reference to FIGS. 1 and 2, an alternate embodiment of the combustion seal 38 is indicated at 38A. The combustion seal 38A defines a bore 42 that extends the length of the combustion seal 38A. The bore 42 includes first and second tapering portions 45 and 46, respectively, extending from the midline or center of the combustion seal 38A and tapering outward. The first and second tapering portions 45 and 46 have a taper configured to generally complement the taper angle Θ of the generally tapering portion 37. The first and second tapering portions 45 and 46 provide a measure of error-proofing for assembly purposes since the orientation of the combustion seal 38A as the combustion seal 38A is inserted into the generally annular groove 36 is irrelevant.

Figure 4:
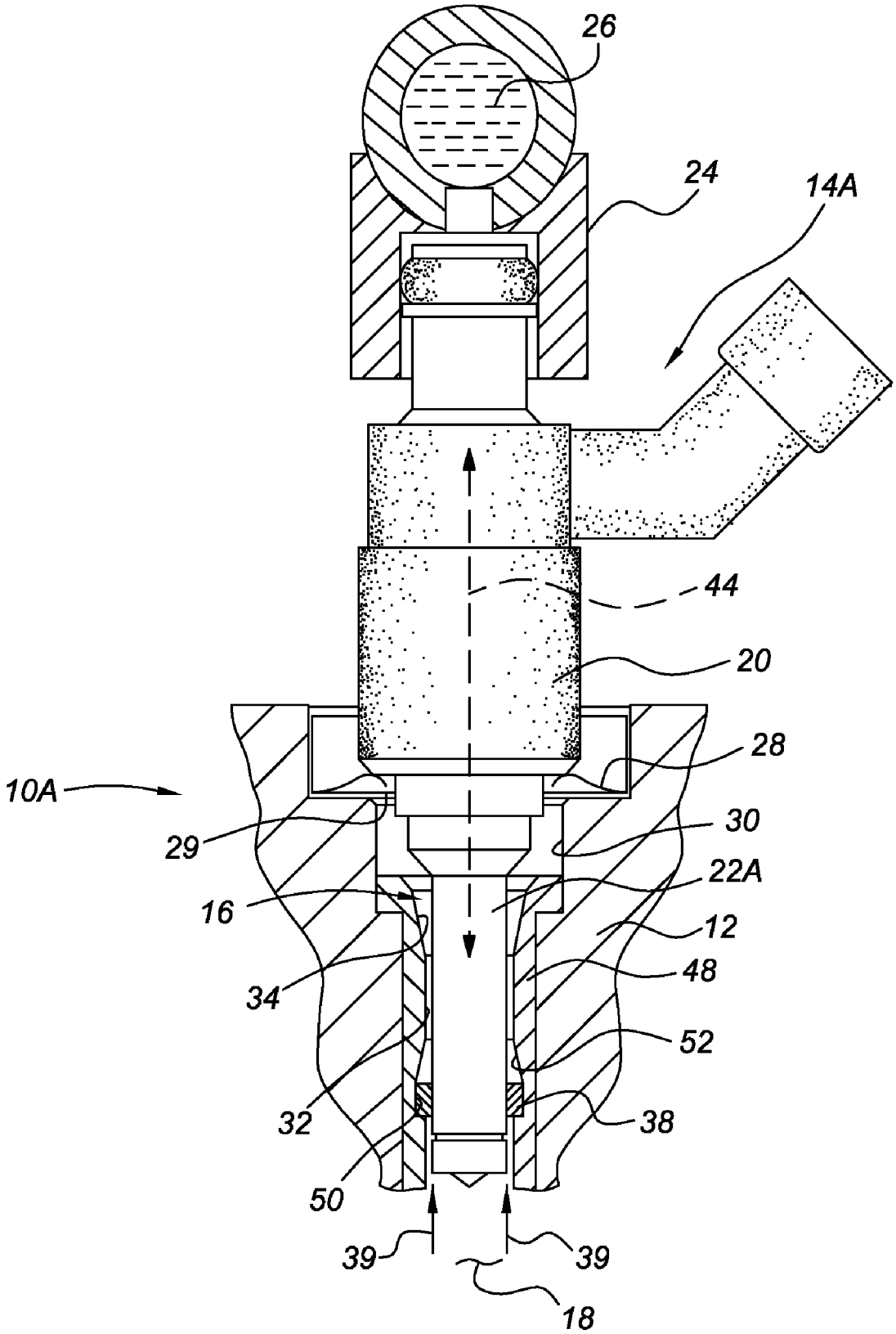
FIG. 4 is a sectional view of an alternate embodiment of the cylinder head assembly of FIG. 1.

Referring now to FIG. 4, there is shown an alternate embodiment of the cylinder head assembly 10 of FIG. 1, generally indicated at 10A. The cylinder head assembly 10A includes a fuel injector assembly 14A. The fuel injector assembly 14A includes the injector body 20 having an injector tip portion 22A extending therefrom. The annular groove 36 defined by injector tip portion 22 of FIG. 1 is lacking in the injector tip portion 22A of FIG. 4. An injector piloting sleeve 48 is mounted with respect to the cylinder head 12 and defines the generally tapering bore portion 34 and the generally cylindrical bore portion 32 of the injector bore 16. The injector piloting sleeve 48 may be retained within the cylinder head 12 by interference fit, threaded engagement, or other fastening means. The injector piloting sleeve 48 defines an annular groove 50 configured to receive a portion of the combustion seal 38. The annular groove 50 may be formed by a machining operation. The injector piloting sleeve 48 may be formed by a powdered metal process.

The combustion seal 38 sealingly engages the injector tip portion 22A of the fuel injector assembly 14A. The annular groove 50 is preferably formed in the second generally cylindrical bore portion 32. The annular groove 50 includes a generally tapering portion 52 operable to radially compress the combustion seal 38 as the combustion seal 38 is biased thereon by combustion gases 39 within the combustion chamber 18. The combustion seal 38 is operable to sealingly engage the second injector tip portion 22A of the fuel injector assembly 14A thereby preventing combustion gases 39 from traversing the injector bore 16 during operation of the engine.

Figure 5:
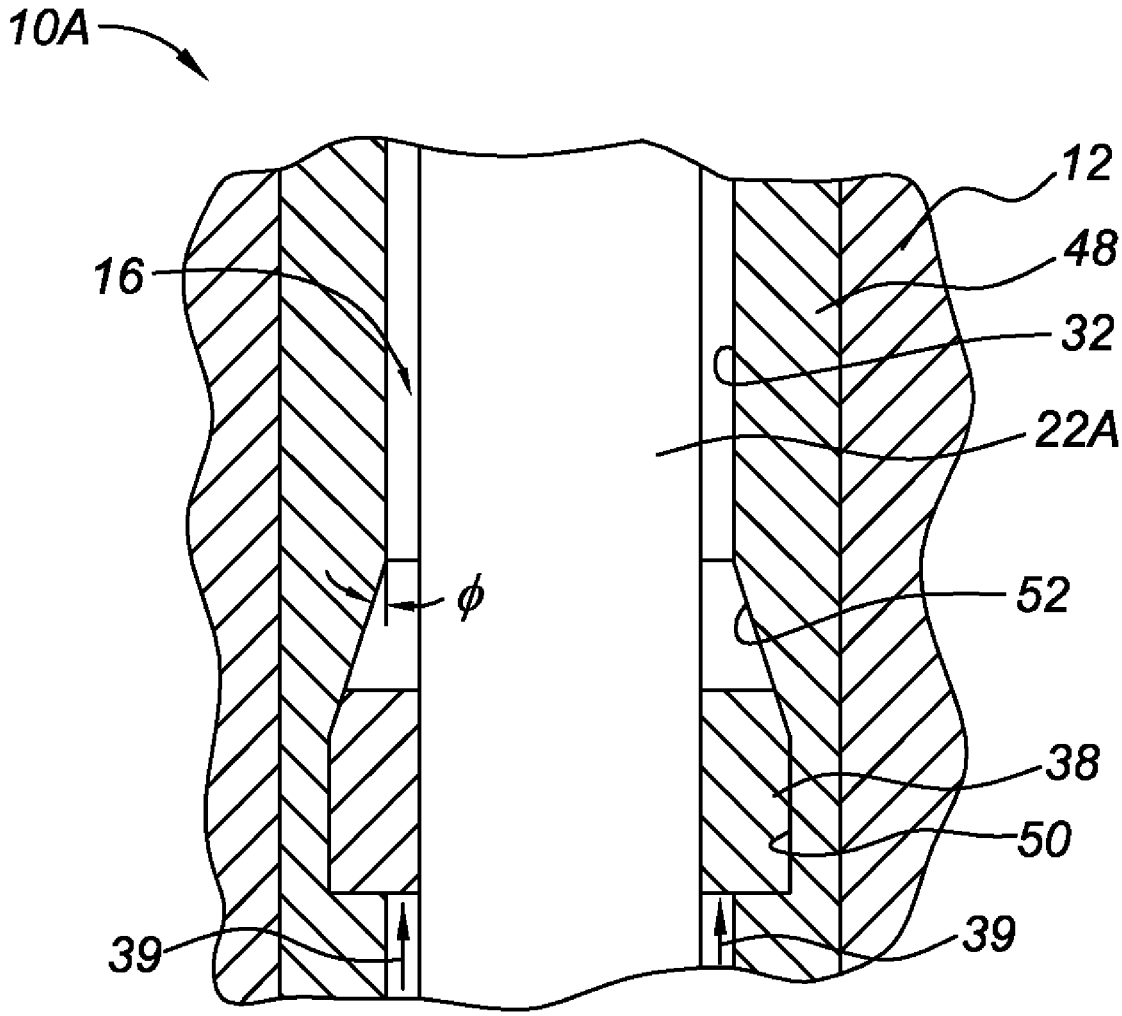
FIG. 5 is a magnified view of a portion of the cylinder head assembly of FIG. 4.

Referring to FIG. 5 and with continued reference to FIG. 4, there is shown a portion of the cylinder head assembly 10A enlarged to illustrate further aspects of the present embodiment. In operation, the combustion seal 38 is subject to pressure forces exerted thereon by the combustion gases 39. As a result, the combustion seal 38 is biased upward, as viewed in FIG. 5, against the generally tapering portion 52 of the annular groove 50. As the combustion seal 38 is biased against the generally tapering portion 52, the generally tapering portion 52 biases or urges the combustion seal 38 radially inward to sealingly engage the injector tip portion 22A of the fuel injector assembly 14A. The combustion seal 38 is energized by the pressure forces of the combustion gases 39 to effect sealing of the injector tip portion 22A with respect to the injector bore 16. Therefore the sealing effectiveness of the combustion seal 38 is proportional to the pressure forces acting on the combustion seal by the combustion gases 39. The generally tapering portion 52 of the annular groove 50 has a taper angle Φ, shown in FIG. 5. In the preferred embodiment the taper angle Φ is approximately 10 to approximately 20 degrees. This range of taper angles will enable ease of insertion and removal of the injector tip portion 22A within the injector bore 16, while maintaining adequate sealing effectiveness of the combustion seal 38 over a range of friction coefficients for the injector bore 16, injector tip portion 22A, and the combustion seal 38.

As described hereinabove, the fuel injector assembly 14A will exhibit small axial movements, as illustrated by arrow 44, as a result of variations in pressure within the combustion chamber 18 and the pressurized fuel 26 within the fuel rail. The isolation member 28 may tend to increase the magnitude of this movement. Since the combustion seal 38 is energized by pressure forces exerted by the combustion gases 39, the combustion seal 38 is operable to maintain a seal between the injector tip portion 22A and the injector bore 16 during the axial movement of the fuel injector assembly 14A.

Additionally, the injector piloting sleeve 48 may be formed from a material having a similar coefficient of thermal expansion as that of the injector tip portion 22A. In this case, close tolerances may be maintained between the second generally cylindrical bore portion 32 and the injector tip portion 22A over a wide range of temperatures. Furthermore, the injector piloting sleeve 48 may be formed without the annular groove 50 for use with the fuel injector assembly 14 of FIG. 1.

While the best modes for carrying out the invention have been described in detail, those familiar with the art to which this invention relates will recognize various alternative designs and embodiments for practicing the invention within the scope of the appended claims.

The invention claimed is:

1. A fuel injector assembly mountable within an injector bore defined by a cylinder head of an internal combustion engine, the fuel injector comprising:

a fuel injector body having an injector tip portion configured to be at least partially received within the injector bore;

an annular groove defined by said injector tip and configured to receive a generally annular combustion seal subject to combustion gas pressures;

wherein said annular groove includes a generally tapering portion;

wherein said generally annular combustion seal is biased against said generally tapering portion of said annular groove as a result of said generally annular combustion seal being subject to combustion gas pressures; and wherein said generally annular combustion seal is biased radially outward to sealingly engage the injector bore when said generally annular combustion seal is biased against said generally tapering portion of said annular groove.

2. The fuel injector assembly of claim 1, wherein said generally annular combustion seal is formed from polytetrafluoroethylene.

3. The fuel injector assembly of claim 1, wherein said generally tapering portion of said annular groove has a taper angle between approximately twelve degrees and twenty degrees.

4. The fuel injector assembly of claim 1, further comprising an isolation member mountable between said injector body and the cylinder head and operable to substantially isolate said fuel injector body from the cylinder head.

5. The fuel injector assembly off claim 1, further comprising a secondary seal operable to seal said injector body with respect to the cylinder head.

6. The fuel injector assembly of claim 1, wherein said generally annular combustion seal is elastically deformable.

7. The fuel injector assembly of claim 6, wherein said generally annular combustion seal is biased against said generally tapering portion of said annular groove and said generally annular combustion seal is biased radially outward to sealingly engage the injector bore when said generally annular combustion seal is biased against said generally tapering portion of said generally annular groove when said generally annular combustion seal is elastically deformed.

8. The fuel injector assembly of claim 6, wherein said generally annular combustion seal is elastically deformed when the generally annular combustion seal is subjected to combustion gas pressures.

9. The fuel injector assembly of claim 1, wherein said generally annular combustion seal has an inner bore, wherein the inner bore tapers from a first end of the generally annular combustion seal to a second end of the generally annular combustion seal.

10. The fuel injector assembly of claim 1, wherein said generally annular combustion seal has an inner bore having a first portion tapering in a first direction from a midpoint of the inner bore and a second portion tapering in a second direction from the midpoint of the inner bore.

11. A cylinder head assembly for an internal combustion engine, the cylinder head assembly comprising:

a cylinder head at least partially defining a combustion chamber and an injector bore;

a fuel injector assembly having an injector body and an injector tip portion;

wherein said injector tip portion is at least partially disposed within said injector bore and in communication with said combustion chamber;

an annular groove defined by said injector tip and configured to receive a generally annular combustion seal subject to combustion gas pressures within said combustion chamber;

wherein said annular groove includes a generally tapering portion;

wherein said generally annular combustion seal is biased against said generally tapering portion of said annular groove as a result of said generally annular combustion seal being subject to combustion gas pressures; and wherein said generally annular combustion seal is biased radially outward to sealingly engage said injector bore when said generally annular combustion seal is biased against said generally tapering portion of said annular groove.

12. The cylinder head assembly of claim 11, wherein said generally annular combustion seal is formed from polytetrafluoroethylene.

13. The cylinder head assembly of claim 11, wherein said generally tapering portion of said annular groove has a taper angle between approximately twelve degrees and twenty degrees.

14. The cylinder head assembly of claim 11, further comprising an isolation member mountable between said injector body and said cylinder head and operable to substantially isolate said fuel injector body from said cylinder head.

15. The cylinder head assembly of claim 11, further comprising a secondary seal operable to seal said injector body with respect to said cylinder head.

16. A cylinder head assembly for an internal combustion engine, the cylinder head assembly comprising:

a cylinder head at least partially defining a combustion chamber;

an injector piloting sleeve mounted within said cylinder head and defining an injector bore;

a fuel injector assembly having an injector body and an injector tip portion;

wherein said injector tip portion is at least partially disposed within said injector bore and in communication with said combustion chamber;

an annular groove defined by said injector piloting sleeve and configured to receive a generally annular combustion seal subject to combustion gas pressures within said combustion chamber;

wherein said annular groove includes a generally tapering portion;

wherein said generally annular combustion seal is biased against said generally tapering portion of said annular groove as a result of said generally annular combustion seal being subject to combustion gas pressures; and wherein said generally annular combustion seal is biased radially inward to sealingly engage said injector tip portion when said generally annular combustion seal is biased against said generally tapering portion of said annular groove.

17. The cylinder head assembly of claim 16, wherein said generally annular combustion seal is formed from polytetrafluoroethylene.

18. The cylinder head assembly of claim 16, wherein said generally tapering portion of said annular groove has a taper angle between approximately ten degrees and twenty degrees.

19. The cylinder head assembly of claim 16, further comprising an isolation member mountable between said injector body and said cylinder head and operable to substantially isolate said fuel injector body from said cylinder head.

20. The cylinder head assembly of claim 16, further comprising a secondary seal operable to seal said injector body with respect to said cylinder head.

* * * * *